US006596342B2

(12) United States Patent
Batliner et al.

(10) Patent No.: US 6,596,342 B2
(45) Date of Patent: Jul. 22, 2003

(54) METHOD OF COATING OF BULK GOODS

(75) Inventors: Rainer Batliner, Schaanwald (LI); Gerald Felder, Feldkirch (AT); Werner Schörghofer, Rankweil (AT)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/027,845

(22) Filed: Dec. 21, 2001

(65) Prior Publication Data

US 2002/0081388 A1 Jun. 27, 2002

(30) Foreign Application Priority Data

Dec. 22, 2000 (DE) ..... 100 65 957

(51) Int. Cl.[7] ..... B05D 3/12

(52) U.S. Cl. ..... 427/242; 427/216; 427/217; 427/221; 427/309; 427/328; 427/331; 427/348; 427/349; 427/422; 427/425; 427/427; 427/455; 427/534

(58) Field of Search ..... 427/455, 534, 427/216, 217, 221, 309, 328, 331, 348, 349, 422, 425, 427, 242

(56) References Cited

U.S. PATENT DOCUMENTS 2,761,420 A * 9/1956 Mottet ..... 118/418
3,874,903 A * 4/1975 Wirth et al. ..... 117/72
4,065,057 A * 12/1977 Durmann ..... 239/79
5,587,006 A * 12/1996 Shepherd et al. ..... 106/1.05

* cited by examiner

*Primary Examiner*—Bernard Pianalto
(74) *Attorney, Agent, or Firm*—Sidley Austin Brown & Wood, LLP

(57) ABSTRACT

A method of coating of mass-produced bulk goods (5) including loading the bulk goods (5) into a rotatable drum (1) through an opening (4) formed in a side surface of the drum (1), heating a coating material in coating apparatus (8), having a spray gun (6) and provided outside of the rotatable drum (1); and thereafter, applying the heated coating material to the bulk goods (5) with the spray gun (6) through the drum opening (4).

4 Claims, 2 Drawing Sheets

METHOD OF COATING OF BULK GOODS

BACKGROUND OF THE INVENTION

1. Field of the Invention

The present invention relates to a method of coating of mass-produced bulk goods and including loading the bulk goods into a rotatable drum through an opening formed in a tide surface of the drum, providing a coating apparatus having a spray gun and arrangeable outside of the rotatable drum, and applying the coating material to the bulk goods with the spray gun.

2. Description of the Prior Art

For protecting from corrosion of mass-produced parts made of steel such, e.g., bolts, nails, screws, etc., they are provided with a coating having a different thickness and formed, e.g., of zinc.

The application of coating can be effected, dependent on the corrosion-resistant requirements the products should meet, by using galvanization, mechanical plating, hot zinc galvanization, etc.

At present, the most widely used coating process is galvanization. For coating, the mass-produced parts in form of bulk goods all displaced, in slowly rotating drums, through different baths.

As a result of the necessary wet-chemical pretreatment and the following metal dissipation, and dependent on the composition of the electrolyte, acidic, alkaline, and as a result of water decomposition, hydrogen can be produced.

The hydrogen can diffuse into the parts and lead, in particular in high-strength parts, to brittle fractures, primarily, to embrittlement.

A cost-intensive malleablizing process, during which the hydrogen is partially removed from the parts, permits to partially compensate the effect of embrittlement.

By further development of the process of producing an electrolyte and by modifying coating apparatuses, the coating process became more ecologically friendly. However, the pollution still remains very high and the manufacturing costs also remain high.

U.S. Pat. No. 5,393,346 discloses a process of coating of mass-produced bulk goods according to which a fluid coating is applied to bulk goods, which are located in a rotatable drum, through an opening formed in the drum. Then, the fluid coating is dried by heating the bulk goods. As a result, a film is formed on separate parts which, however, does not penetrate sufficiently deep into recesses of the parts.

Accordingly, an object of the present invention is to provide an environmentally friendly and cost-effective process for coating mass-produced bulk goods and which would permit to prevent any damaging penetration of hydrogen in separate parts.

SUMMARY OF THE INVENTION

This and other objects of the present invention, which will become apparent hereinafter, are achieved by heating the coating material in the coating apparatus.

During coating, as a result of rotation of the drum, the bulk goods are constantly displaced, and separate parts do not remain in the same location for a relatively long time. The coating material is heated and atomized in a coating apparatus, which is located outside of the drum, and is then applied to the bulk goods displaceable in the drum. The coating material is applied to the bulk goods at a speed from, e.g., 30 m/sec to 850 m/sec. As a result of a continuous movement, separate parts are uniformly coated with the coating material. The thickness of the coating can be controlled by changing the process parameters, e.g., the durability of spraying, and by changing the rate of deposition. The coating material is brought to a molten condition by heating.

For applying the coating on the bulk goods, according to the present invention, all thermal processes, such as autogenous flame-spraying with use of wire, autogenous flame-spraying with powder, flame-spraying of synthetic materials, detonation spraying, arc flame spraying, high-speed flame-spraying, plasma-spraying, laser-spraying, and cold gas-spraying, can be used. As a coating material, wire-shaped material, e.g., zinc wire, powder material, e.g., zinc powder, alloys, plastics, ceramics, and the like can be used.

An intensive cooling of the heated and atomized coating material, which can result from a relatively large distance between the bulk goods and the region of the coating apparatus in which the coating material is atomized, can be prevented by preferably heating the coating material in the spray gun of the coating apparatus located in the vicinity of the bulk goods.

Preferably, the surfaces of separate parts of the bulk goods are roughened and activated before coating by jet-blasting. The roughing and activation of the surfaces of the separate parts lead to a better adhesion of the coating material that is applied to the bulk goods.

The jet-blasting is preferably conducted outside of the drum in compressed-air, sand-blasting, or centrifugal apparatuses with use of fine-grained steel medium that is applied to the bulk goods at a high speed. The parts can have, after being subjected, to jet-blasting, a roughness of 16–20 micron.

An autogenous coating results in a relatively rough coating surface. If necessary, the surfaces of the parts can be subjected, after coating to smoothing. During the smoothing process, the typical, for a coating process, roughness is evened and the coating layer is compressed. This improves the appearance of the coating and the corrosion-resistance characteristics.

The coated bulk goods, preferably, are subjected to smoothing outside of the drum in a smoothing apparatus with use of at least one auxiliary element. As an auxiliary element, small, polished steel balls having a diameter from, e.g., 0.3 mm to about 5 mm, can be used. The container of the smoothing apparatus can, during the smoothing process, rotate or wobble. The container can have a cylindrical shape and be provided with a conveying screw for transporting the to-be-smoothed bulk goods and the auxiliary element(s) from the entrance of the container to the opposite-end.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

The coating process according to the present invention is designed for coating bulk goods 5 such as, e.g., pin-shaped elements like nails. The coating is effected by first using, e.g., jet-blasting process (step A) that takes place in (not shown) compressed-air apparatus, sand-blasting apparatus, or in centrifugal apparatuses. With the jet-blasting process, a fine-grained blasting medium is thrown onto the bulk goods 5 at a very high speed. The jet-blasting process not only permits to obtain clean surfaces but also roughens them, which insures a particular good adhesion of a coated material to the coatable bulk goods during a subsequent coating process.

The coating takes place in step B when a heated and atomized coating material, which serves for protection from corrosion, is applied on the outer surfaces of the bulk goods.

Figure 1:
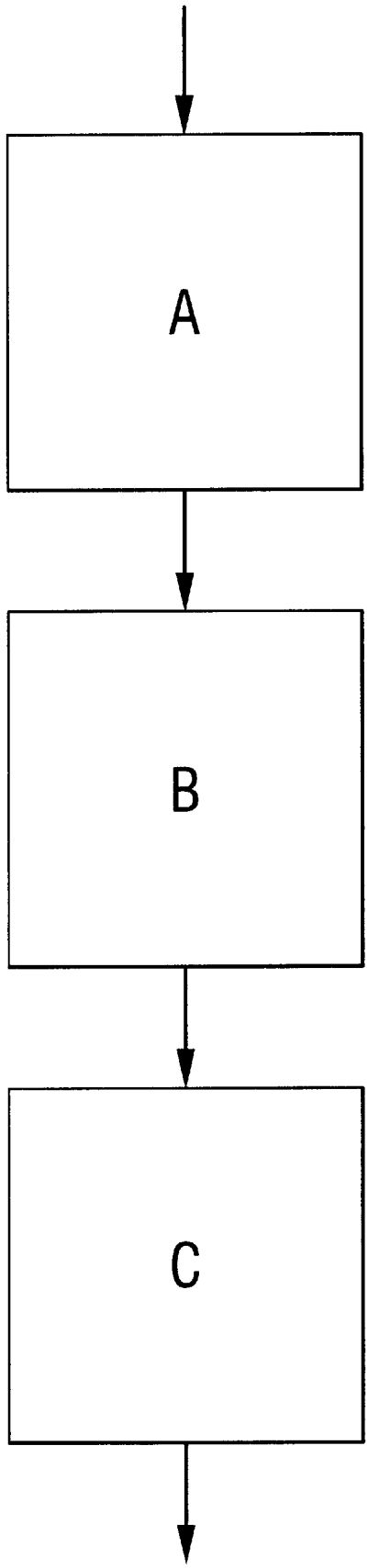
FIG. 1 shows a schematic new showing a sequence of steps of a coating process according to the present invention.
Figure 2:
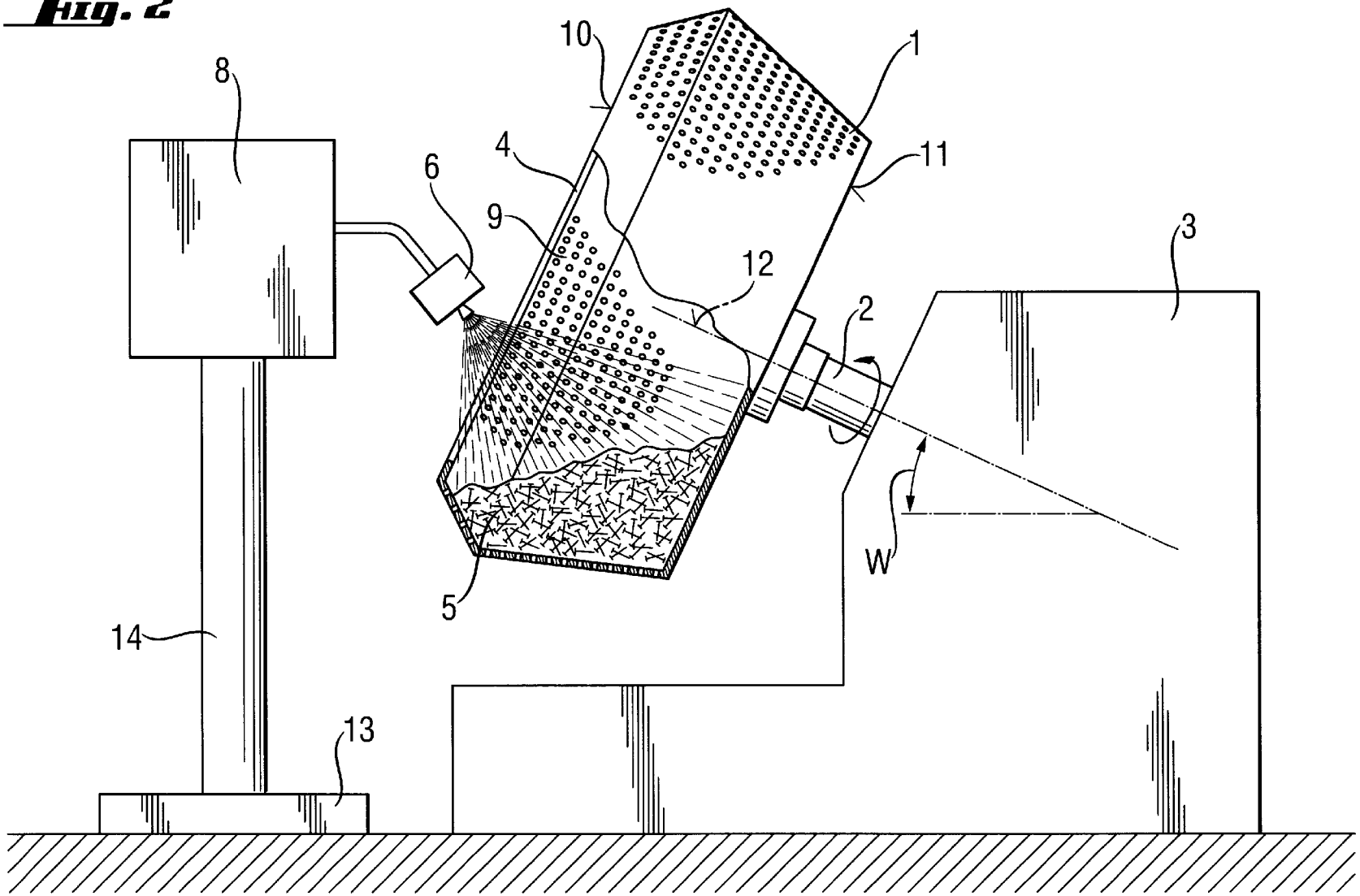
FIG. 2 shows a schematic view showing an apparatus for effecting a coating process according to the present invention.

FIG. 2 shows a schematic view of an apparatus for applying the coating material on the bulk goods 5. As shown in FIG. 2, the bulk goods, a large number of nails, are located in a rotatable drum 1. The rotational axis of the drum 1 is inclined to a horizontal at an angle of about 25°. The drum 1 has a drive shaft 2 connectable with a drive 3. The drive shaft 2 coincides with the rotational axis 12 of the drum 1.

The drum has, at its first end side 10, an opening 4 for feeding the bulk goods 5 into the drum 1 and for taking the coated bulk goods out. The drum 1 is connected with the drive shaft 2 at its other, opposite end side 11. The drum 1 is formed of a perforated sheet metal with the holes therein, which are not located too closely to each other, having a diameter of about 2 mm. The holes are spaced from each other by a distance also equal to about 2 mm.

The drum 1 is formed of two conical sections having different sizes, with the large section narrowing toward the drive 3 in the longitudinal direction of the drum 1. The smaller section narrows in the opposite direction toward the first end side 10 in which the opening 4 is formed.

In order to prevent concentration of the bulk goods 5 in the corners of the drum 1 as a result of centrifugal forces acting on the bulk goods 5, the receiving chamber of the drum 1 preferably narrows at least to the second end side 11. When the drum is designed for receiving a large quantity of bulk goods, it is so formed that it also conically narrows, at least partially, also to the first end side 10. In this case the size of the opening 4 becomes somewhat reduced.

Good feeding of the bulk goods into a drum and their taking out of the drum is achieved with a rotational axis of the drum being inclined to a horizontal at an angle from 1° to 90°, in particular, at an angle between 20° and 30°.

The bulk goods, which were loaded into the drum 1, during coating, are continuously displaced. A spray gun 6 forms a component of a coating apparatus 8. In the spray gun 6, the coating material is heated and is atomized at a high pressure, and then, is applied to the bulk goods. Dependent on the inclination of the drum 1 and the size of the opening 4, the spray gun 6 is located a short distance from the opening 4 or, e.g., projects thereinto.

The coating apparatus 8 is supported on the ground by a base plate 13 and an uprise 14. For displacement of the spray gun 6, a special handling system can be provided.

After coating, the bulk goods 5 are subjected to a smoothing operation (step C). The coating material is applied to rough surfaces of separate parts of bulk goods 5. After coating, these surfaces are smoothed and compressed in a smoothing apparatus (not shown). The smoothing and compression improve the characteristics of the coating and the optical appearance of the parts. The smoothing is effected outside of the drum 1 in a container of the smoothing apparatus with smoothing means such as polished steel balls. The container of the smoothing apparatus is subjected to a rotational or wobbling movement. By integration, the steps A, B, and C can be effected in one or two apparatus. Also, the steps B and C can be effected simultaneously or sequentially.

Though the present invention was shown and described with references to the preferred embodiment, such are merely illustrative of the present invention and are not to be construed as a limitation thereof, and various modifications to the present invention will be apparent to those skilled in the art. It is, therefore, not intended that the present invention be limited to the disclosed embodiment or details thereof, and the present invention includes all of variations and/or alternative embodiments within the spirit and scope of the present invention as defined by the appended claims.

What is claimed is:

1. A method of coating of mass-produced bulk goods (5), comprising the steps of loading the bulk goods (5) into a rotatable drum (1) through an opening (4) formed in a side surface of the drum (1); providing a coaling apparatus (8) having a spray gun (6) and arrangeable outside of the rotatable drum (1); healing and melting a coating material in the coating apparatus (8); thereafter, applying the molten coating material to the bulk goods (5) with the spray gun (6) through the drum opening (4); and smoothing coated surfaces of the bulk goods (5), wherein the smoothing of the coated surfaces of the bulk goods (5) is effected in a smoothing apparatus located outside of the drum (1) by using auxiliary smoothing means.

2. A method according to claim 1, wherein the heating of the coating material is effected with the spray gun (6).

3. A method according to claim 1, further comprising the step of jet-blasting the bulk goods (5) before applying coating thereon for roughing and activating surfaces of the bulk goods (5).

4. A method according to claim 3, wherein the jet-blasting is effected by using one of compressed-air apparatus, sand-blasting apparatus, and centrifugal apparatus located outside of the drum (1).

* * * * *